US010952004B2

(12) United States Patent
Valavanis

(10) Patent No.: US 10,952,004 B2
(45) Date of Patent: Mar. 16, 2021

(54) SPATIAL DELIVERY OF MULTI-SOURCE AUDIO CONTENT

(71) Applicant: MICROSOFT TECHNOLOGY LICENSING, LLC, Redmond, WA (US)

(72) Inventor: George Michael Valavanis, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/298,975

(22) Filed: Mar. 11, 2019

(65) Prior Publication Data

US 2019/0364377 A1 Nov. 28, 2019

Related U.S. Application Data

(63) Continuation of application No. 15/986,537, filed on May 22, 2018, now Pat. No. 10,237,675.

(51) Int. Cl.

| | |
|---|---|
| ***H04S 5/00*** | (2006.01) |
| ***H04S 7/00*** | (2006.01) |
| ***H04R 3/04*** | (2006.01) |

(52) U.S. Cl.

CPC ..... *H04S 5/00* (2013.01); *H04R 3/04* (2013.01); *H04S 7/30* (2013.01); *H04S 7/304* (2013.01);

(Continued)

(58) Field of Classification Search

CPC ... H04S 5/00; H04S 7/30; H04S 7/302; H04S 7/304; H04S 2400/11; H04S 2400/13;

(Continued)

(56) References Cited

U.S. PATENT DOCUMENTS 6,011,851 A 1/2000 Connor et al.
6,850,496 B1 2/2005 Knappe et al.

(Continued)

FOREIGN PATENT DOCUMENTS

CN 101184349 A 5/2008

OTHER PUBLICATIONS

Cadambi, Akshay, "Lithe: An Object-Based Audio-Graph Framework for Spatial Composition and sound Design", In Project Documentation Submitted in Partial Fulfillment for the degree of Master of Science in Media, Arts and Technology, Jan. 2017, 47 Pages.

(Continued)

*Primary Examiner* — Jason R Kurr

(74) *Attorney, Agent, or Firm* — Newport IP, LLC; Han Gim

(57) ABSTRACT

A system for enabling spatial delivery of multi-source audio data to a user based on a multi-layer audio stack is provided. The multi-layer audio stack includes a central layer located within a predetermined vertical distance from a reference line associated with the user, such as the horizon line of the user. The multi-layer audio stack can also include an upper layer located above the central layer and/or a lower layer located below the central layer. Audio data from multiple sources are collected and prioritized based on context data gathered for the user. Audio data on which the user would like to focus is assigned the highest priority and delivered on the central layer. Audio data that the user does not currently focus on, but would like to visit next, can be assigned a lower priority and be delivered in the upper layer or the lower layer. The user can shift the multi-layer audio stack up or down to navigate through the audio data rendered at different layers of the stack.

19 Claims, 7 Drawing Sheets

(52) U.S. Cl.
CPC ..... *H04R 2460/07* (2013.01); *H04S 2400/11* (2013.01); *H04S 2400/13* (2013.01); *H04S 2400/15* (2013.01); *H04S 2420/01* (2013.01)

(58) Field of Classification Search
CPC ... H04S 2400/15; H04S 2420/01; H04R 3/04; H04R 1/20; H04R 1/22; H04R 1/24; H04R 1/2803; H04R 1/32; H04R 1/323; H04R 2460/07
See application file for complete search history.

(56) References Cited

U.S. PATENT DOCUMENTS

| | | | | |
|---|---|---|---|---|
| 8,150,044 | B2 | 4/2012 | Goldstein et al. | |
| 9,716,939 | B2 | 7/2017 | Di Censo et al. | |
| 9,774,979 | B1 * | 9/2017 | Morishita | H04S 7/304 |
| 10,531,196 | B2 * | 1/2020 | Family | H04R 1/403 |
| 2002/0154179 | A1 * | 10/2002 | Wilcock | G11B 19/025 715/716 |
| 2002/0196947 | A1 | 12/2002 | Lapicque | |
| 2011/0153043 | A1 | 6/2011 | Ojala | |
| 2016/0345115 | A1 * | 11/2016 | Paik | H04S 7/303 |

OTHER PUBLICATIONS

Cheng, Grace, "How Mixed Reality Improves Learning", Retrieved from: https://www.linkedin.com/pulse/how-mixed-reality-improves-learning-grace-cheng, Jul. 20, 2016, 10 Pages.

"International Search Report and Written Opinion Issued in PCT Application No. PCT/US2019/021718", dated May 27, 2019, 12 Pages.

* cited by examiner

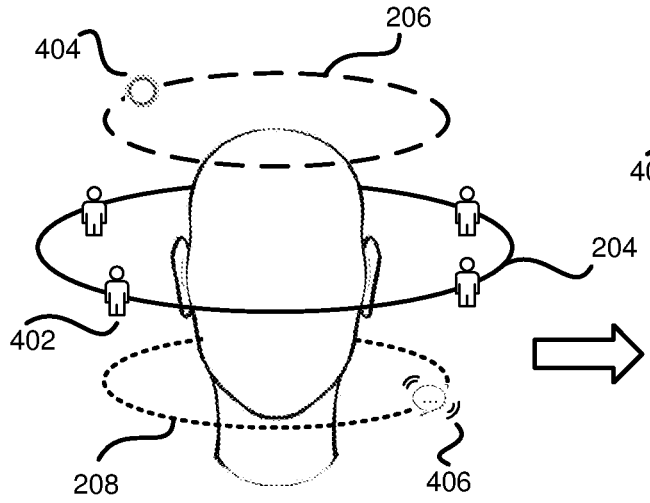
FIGURE 4A
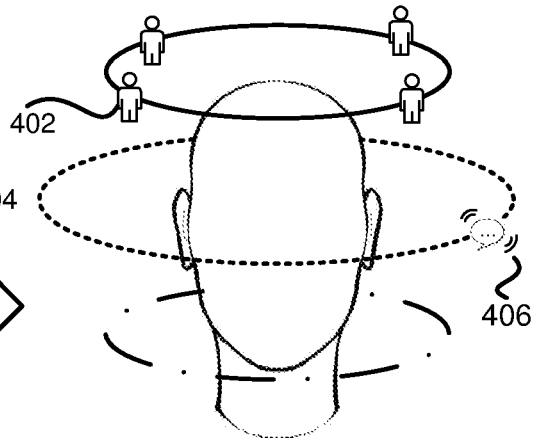
FIGURE 4B
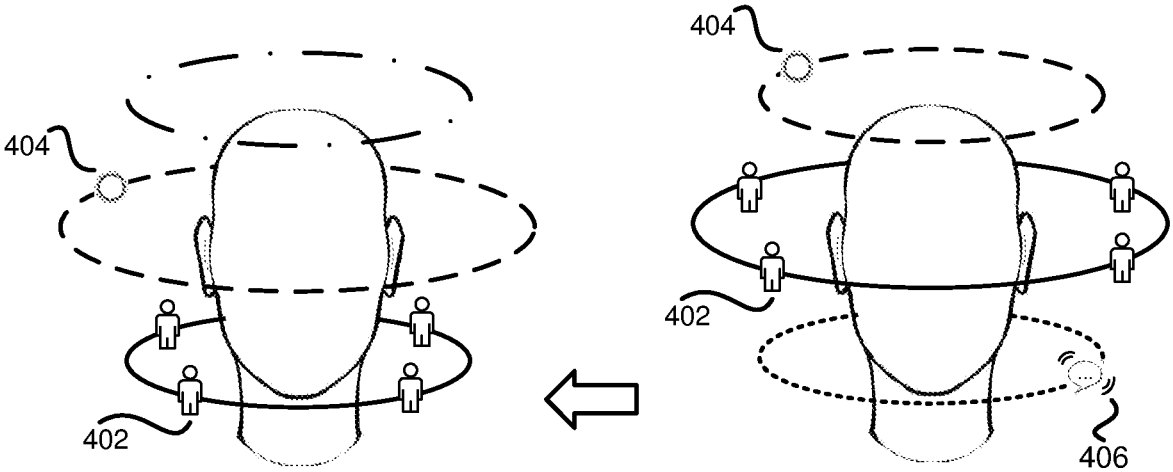
FIGURE 4D
FIGURE 4C

SPATIAL DELIVERY OF MULTI-SOURCE AUDIO CONTENT

PRIORITY INFORMATION

This application claims the benefit of and priority to U.S. patent application Ser. No. 15/986,537, filed May 22, 2018, the entire contents of which are incorporated herein by reference.

BACKGROUND

Today's technology climate can inundate a person with numerous audible signals simultaneously calling for his/her attention. For example, a computing device can execute an application, such as a conferencing application, that can generate an audible signal from individual sources, such as a playback of a media file, a person giving a presentation, background conversations, etc. Such a scenario is helpful in communicating ideas and content. However, a person's auditory input bandwidth is limited. When a number of audible sources reach a threshold, a person may have difficulties in distinguishing different audio signals and focusing on the ideas or content conveyed from each source.

When a person hears a number of sounds that are competing for his or her attention, that person may experience desensitization to each sound. This problem can be exacerbated with the introduction of new technologies, such as virtual reality ("VR") or mixed reality ("MR") technologies. In such computing environments, there may be a large number of sounds competing for a user's attention, thus resulting in confusion and desensitization to each sound. Such a result may reduce the effectiveness of an application or the device itself.

It is with respect to these and other considerations that the disclosure made herein is presented.

SUMMARY

The techniques disclosed herein enable a system to prioritize and present sounds from multiple audio sources to a listener/user in a vertically distributed multi-layer audio stack to decrease cognitive load and increase focus of the listener/user. In some configurations, the system can collect, receive, access or otherwise obtain audio data from multiple audio sources. An audio source can be a software application generating, playing, or transmitting sounds, live or prerecorded. The collected audio data/audio sources can then be prioritized based on the context of a moment the user is in. This context can be established over time by the system observing the user's usage behavior and/or as the user specifies a series of preferences/settings for each audio source.

The prioritized audio data can then be delivered to the user through a multi-layer audio stack. The multi-layer audio stack can contain multiple layers that are vertically distributed, including a central layer, one or more upper layers and/or one or more lower layers. The central layer can include a spatial region around the user's head at an elevation within a predetermined vertical distance from a reference line associated with the user, such as the user's horizon line, the line at the elevation of the user's ears, nose, eyes, etc. The upper layer can include a spatial region at an elevation higher than the spatial region of the central layer and thus is further away from the user's reference line than the central layer. The lower layer can include a spatial region at an elevation lower than the central layer and is also further away from the user's reference line than the central layer. According to one configuration, the size of the region included in the central layer is larger than that of the lower layer and the upper layer.

In one configuration, the reference line associated with the user can be selected at the user's horizon line because the optimal human spatial hearing range is typically at the user's horizon line. As sounds move above and below the horizon line, identifying sound source location becomes difficult. Accordingly, delivering the prioritized audio data can be performed by rendering the audio data having the highest priority, i.e. the audio data associated the audio source having the highest priority, to the central layer. Those audio data having a lower priority, i.e. associated with an audio source having a lower priority, can be rendered at a lower layer or an upper layer. In this way, the user can focus his/her attention at the audio data rendered at the central layer while he/she can still vaguely hear the sound in the two adjacent layers above and below the central layer as background sounds. It should be understood that the reference line can be selected at any other location associated with the user. The system can render the audio data using any spatialization technology, such as Dolby Atmos, head-related transfer function ("HRTF"), etc.

The user can also interact with the multi-layer audio stack to change focus. For example, the user can instruct the system to shift the stack upward or downward to change his or her attention to the audio data rendered at an upper or a lower layer. The upward shilling can cause a lower layer to be shifted to the position of the center layer and resized to the size of the center layer. As a result the audio content previously presented in the lower layer is presented in the central layer after the shifting. Similarly, the downward shifting can cause an upper layer to be shifted to the position of the center layer and resized to the size of the center layer. The audio content previously presented at the upper layer is rendered at the central layer after the shifting. The audio data that was previously rendered at the central layer would be rendered at the lower layer in a downward shifting and at the upper layer in an upward shifting as background sound. The shifted central layer can also be resized to match the size of the corresponding upper layer or lower layer.

The techniques disclosed herein provide a number of features to enhance the user experience. In one aspect, the techniques disclosed herein allow multiple audio sources to be presented to a user in an organized way without introducing additional cognitive load to the user. Each audio source is made aware of other audio sources when prioritizing the audio sources. As such, a user is able to hear important audio data and focus on its content without being distracted by other audio signals. The techniques disclosed herein also enable the user to switch his/her focus on the audio data by shifting the audio stack upward or downward. This allows the user to change smoothly between different audio sources without introducing unnatural and uncomfortable abrupt changes in the rendered audio data.

Consequently, the features provided by the techniques disclosed herein significantly improve the human interaction with a computing device. This improvement can increase the accuracy of the human interaction with the device and reduce the number of inadvertent inputs, thereby reducing the consumption of processing resources and mitigating the use of network resources. Other technical effects other than those mentioned herein can also be realized from implementations of the technologies disclosed herein.

It should be appreciated that the above-described subject matter may also be implemented as a computer-controlled apparatus, a computer process, a computing system, or as an article of manufacture such as a computer-readable medium. These and various other features will be apparent from a reading of the following Detailed. Description and a review of the associated drawings. This Summary is provided to introduce a selection of concepts in a simplified form that are further described below in the Detailed Description.

This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicates similar or identical items.

FIG. 4A illustrates an example of rendering multiple audio sources in the multi-layer audio stack.

FIG. 4B illustrates the rendering of the multiple audio sources shown in FIG. 4A after the user instructs that the audio stack be shifted upward.

FIG. 4C illustrates the rendering of the multiple audio sources shown in FIG. 4B back to its initial position after the user instructs that the audio stack be shifted back downward.

FIG. 4D illustrates the rendering of the multiple audio sources shown in FIG. 4C after the user instructs that the audio stack be shifted downward.

DETAILED DESCRIPTION

Figure 1:
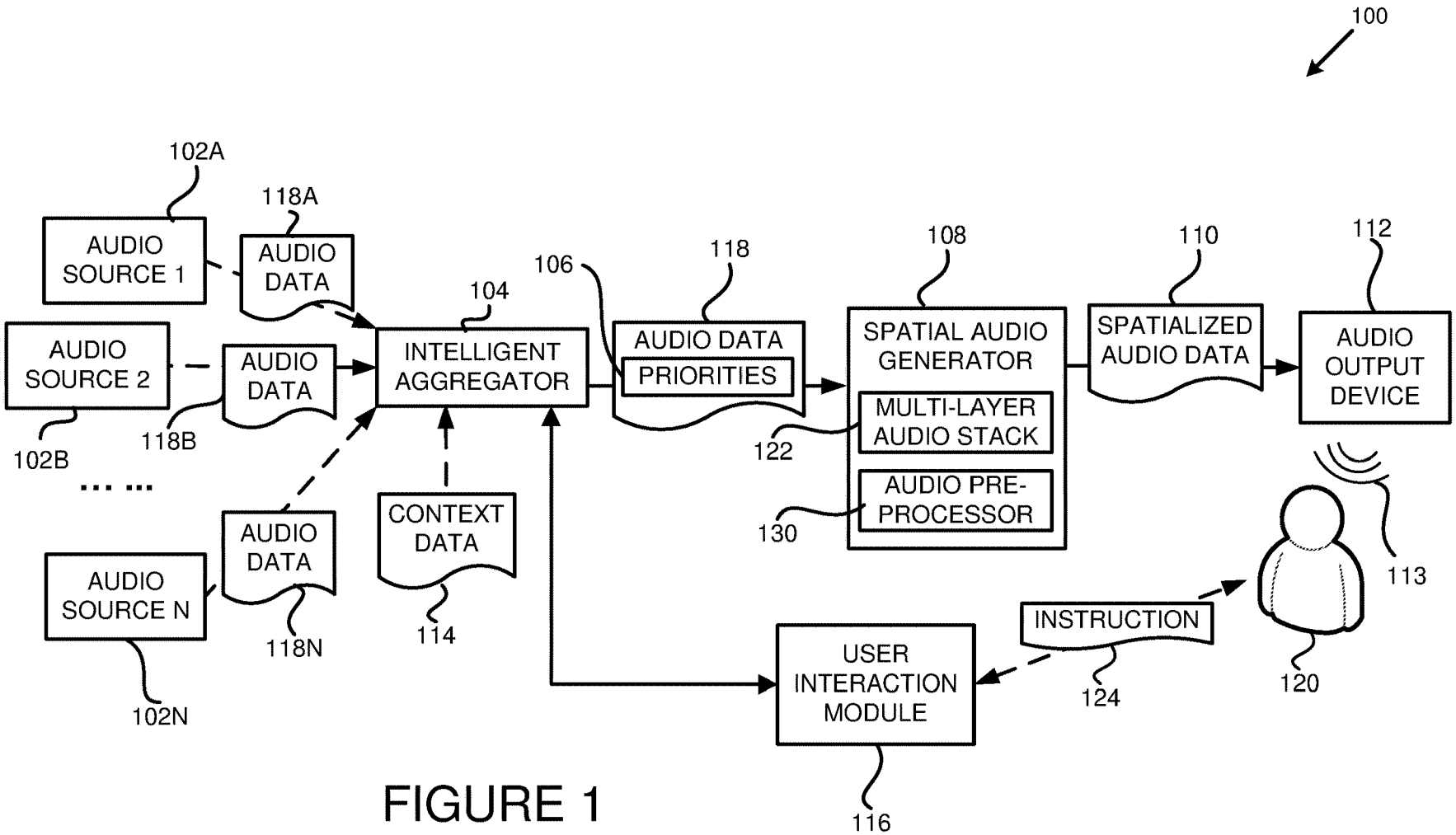
FIG. 1 illustrates an example system for spatial delivery of multi-source audio data in a multi-layer audio stack.

The following Detailed Description discloses techniques and technologies for spatial delivery of multi-source audio data in a multi-layer audio stack. The multi-layer audio stack can include multiple layers that are vertically distributed, comprising a central layer, one or more upper layers and/or one or more lower layers. The central layer can include a spatial region around the user's head at an elevation within a predetermined vertical distance from a reference line of the user. For example, the reference line can be at the user's horizon line, a line at the elevation of the user's ears, nose, eyes, or any other location associated with the user. The upper layer can include a spatial region at an elevation higher than the spatial region of the central layer and thus is further away from the reference line than the central layer. The lower layer can include a spatial region at an elevation lower than the spatial region of the central layer and is also further away from the reference line than the central layer. According to one configuration, the size of the central layer region is larger than that of the lower layer region and the upper layer region.

Audio data from multiple audio sources can be collected and organized by assigning priorities to each of the audio sources and their associated audio data. The audio data having the highest priority can be delivered to the central layer so that the user can hear clearly the audio data and thus devote his/her focus on it. Those audio data having a lower priority can be rendered at a lower layer or an upper layer (relative to the central layer) as a background sound that the user is aware of, but which does not distract the user from the audio data in the central layer.

The user can interact with the multi-layer audio stack to switch his focus from one layer to another. For example, the user can instruct the system to shift the stack upward or downward to change his or her attention to the audio data rendered at a lower or an upper layer, respectively. The upward shifting can cause the audio data rendered at a lower layer to be rendered at the central layer. Similarly, the downward shifting can cause the audio data rendered at an upper layer to be rendered the central layer. The audio data that was previously rendered at the central layer would be rendered at a lower layer in a downward shifting and at an upper layer in an upward shifting, as a background sound.

The techniques disclosed herein significantly enhance the user experience. In one aspect, the techniques disclosed herein make each audio source known by other audio sources when prioritizing the audio sources, thereby allowing the multiple audio sources to be presented to a user in an organized way without introducing additional cognitive load to the user. The techniques disclosed herein also enable the user to smoothly switch his focus on the audio data by shifting the audio stack upward or downward. This feature allows the user to change smoothly between different audio sources without introducing unnatural and uncomfortable abrupt changes in the rendered audio data.

It should be appreciated that the above-described subject matter may be implemented as a computer-controlled apparatus, a computer process, a computing system, or as an article of manufacture such as a computer-readable storage medium. Among many other benefits, the techniques disclosed herein improve efficiencies with respect to a wide range of computing resources. For instance, human interaction with a device may be improved as the use of the techniques disclosed herein enables a user to focus on audio data that he is interested in while being aware of other background audio data provided by the device. The improvement to the user interaction with the computing device can increase the accuracy of the human interaction with the device and reduce the number of inadvertent inputs, thereby reducing the consumption of processing resources and mitigating the use of network resources. Other technical effects other than those mentioned herein can also be realized from implementations of the technologies disclosed herein.

While the subject matter described herein is presented in the general context of program nodules that execute in conjunction with the execution of an operating system and application programs on a computer system, those skilled in the art will recognize that other implementations may be performed in combination with other types of program modules. Generally, program modules include routines, programs, components, data structures, and other types of structures that perform particular tasks or implement particular abstract data types. Moreover, those skilled in the art will appreciate that the subject matter described herein may be practiced with other computer system configurations, including hand-held devices, multiprocessor systems, microprocessor-based or programmable consumer electronics, minicomputers, mainframe computers, and the like.

In the following detailed description, references are made to the accompanying drawings that form a part hereof, and in which are shown by way of illustration specific configurations or examples. Referring now to the drawings, in which like numerals represent like elements throughout the several figures, aspects of a computing system, computer-readable storage medium, and computer-implemented methodologies for spatial delivery of multi-source audio data.

FIG. 1 is an illustrative example of a system 100 configured to spatially deliver audio data from multiple audio sources in a multi-layer audio stack. An intelligent aggregator 104 can collect, receive, access or otherwise obtain audio data 118A-118N (which may be referred to herein as audio data 118) that are to be delivered to a user 120 from multiple audio sources 102A-102N (which may be referred to herein individually as an audio source 102 or collectively as the audio sources 102). The audio source 102 might be a software application having audio data 118 associated therewith. For example, the audio source 102 might be a network meeting application where two or more participants are generating audio data 118 in real time through their respective microphones, such as CISCO WEBEX provided by CISCO SYSTEMS, Inc. of San Jose, Calif., GOTOMEETING provided by CITRIX SYSTEMS, INC. of Santa Clara, Calif., ZOOM provided by ZOOM VIDEO COMMUNICATIONS of San Jose, Calif., GOOGLE HANGOUTS by ALPHABET INC. of Mountain View, Calif., and SKYPE FOR BUSINESS and TEAMS provided by MICROSOFT CORPORATION, of Redmond, Wash. The meeting application might also be a MR/VR meeting service, such as PRISM provided by OBJECTIVE THEORY LLC of Portland, Oreg., CISCO SPARK provided by CISCO SYSTEMS, Inc. of San Jose, Calif. and BIGSCREEN provided by BIGSCREEN, INC. of Berkeley, Calif.

The audio source 102 might also be a voice assistant application where a single object is generating audio data 118, such as CORTANA provided by MICROSOFT CORPORATION, of Redmond, Wash., ALEXA provided by AMAZON.COM of Seattle, Wash., and SIRI provided by APPLE INC. of Cupertino, Calif. The audio source 102 might also be an application configured to play pre-recorded audio data 118, such as a standalone media player or a player embedded in other applications such as a web browser. The audio source 102 can be any other type of software that can generate or otherwise involve audio data 118, such as a calendaring application or service that can play ring tones for various events, an instance of a service in an MR environment, or a combination of service, people and place in the MR environment, also referred to herein as a "workflow." Workflows can be created through user interactions with the system which is outside the scope of this application.

After collecting the audio data 118 from the audio sources 102, the intelligent aggregator 104 can assign a priority 106 to each of the audio source 102 and its associated audio data 118. The highest priority $p_1$ (not shown on FIG. 1) can be assigned to an audio source 102 and its associated audio data 118 that the user 120 would like to focus on at the moment. A lower priority $p_2$ (also not shown on FIG. 1) can be assigned to an audio source 102 that the user would like to hear, but does not want to put full attention on, or to an audio source 102 that the user 120 most likely will want to focus on next as determined by the intelligent aggregator 104. An even lower priority $p_3$ (also not shown on FIG. 1) can be assigned to audio sources 102 that the user 120 is less interested in. Additional priority values p can be employed to prioritize the audio resources as needed.

In one implementation, the priorities 106 can be assigned based on a context of the moment the user 120 is in. The context can be described in context data 114 that can be established over time by the system observing the user's usage behavior and/or as the user 120 specifies a series of preferences or settings for each audio source 102 as needed. The intelligent aggregator 104 can use preference/settings inputs from the user 120 along with signals from other users, the place the user 120 is in, and things the user 120 is interacting with to determine the priority of each incoming audio data 118.

For example, consider a scenario where the user 120 is in an MR meeting instance discussing a new design of a car presented through a 3D rendering. The MR meeting instance can be an application supporting online meetings by two or more participants. The user 120 might want to launch an annotation instance to attach an audio annotation to a digital object in the MR experience that represents a component of the car. The annotation instance can be an application for creating and/or playing back audio annotations. In this example, the MR meeting instance can be considered one audio source 102 and the annotation instance can be considered another audio source 102. The intelligent aggregator 104 can build context data 114 to record that this particular user 120 has launched the annotation instance when in an MR meeting instance in his office.

Based on this context data 114, the intelligent aggregator 104 can assign a high priority 106 to the MR meeting instance and a low priority 106 to the annotation instance. The next time the user is in a MR meeting in his office, the intelligent aggregator 104 can prioritize the audio data from the MR meeting instance to have the highest priority $p_1$ and the audio data from the annotation instance, i.e. the audio annotation, to have the lower priority $p_2$ even if the audio data 118 of the annotation instance has not been received by the intelligent aggregator 104. The assumption is made that the user 120 will most likely need the annotation instance next. Over time, the intelligent aggregator 104 can build a complex understanding of audio source priorities. While, in the above example, the location is used as a factor to determine the context of the moment the user 120 is in, many other factors can contribute to the context graph the intelligent aggregator 104 is building.

The audio data 118 along with their respective priorities 106 can then be sent to a spatial audio generator 108. Based on the priorities 106, the spatial audio generator 108 can allocate the audio data 118 to a multi-layer audio stack 122 that can include a central layer, one or more upper layers and/or one or more lower layers. Each of the central layer, upper layers and/or lower layers can include a spatial region around the head of the user 120. Details regarding the multi-layer audio stack 122 will be described below with regard to FIGS. 2-4. When allocating the audio data 118 to the multi-layer audio stack 122, the spatial audio generator 108 can utilize any spatialization technology, such as Dolby Atmos, or HRTF, to generate spatialized audio data 110. The spatial audio generator 108 can generate spatialized audio data 110 that includes one or more audio streams for the audio data 118, and then associate each of the audio streams with an audio object. Each of the audio objects can then be associated with a location, which in some configurations, is defined by a three-dimensional coordinate system.

For example, the audio data 118 of an online meeting with four participants can be used to generate four audio streams, with one audio stream per participant. Each of the four audio streams can be associated with an audio object. If the audio data 118 of the online meeting is assigned to be delivered at the central layer, the four audio objects can each be associated with a location within the spatial region of the central layer with a minimum distance between each pair of the audio objects. If the audio data 118 is assigned to be delivered to an upper layer or a lower layer, then the four audio objects can each be associated with a location within the spatial region of the corresponding upper layer or lower layer.

The spatialized audio data 110 may then be delivered to and rendered at the audio output device(s) 112 to generate an audible sound 113 for the user 120. The audio output device 112 can be a speaker system supporting a channel-based audio format, such as stereo, 5.1 or 7.1 speaker configuration, or speaker(s) supporting an object-based format. The audio output device 112 may also be a headphone. In configurations where the audio output device 112 includes physical speakers, an audio object can be associated with a speaker at the location of the audio object and the audible sound 113 from the audio stream associated with that audio object emanates from the corresponding speaker. An audio object can also be associated with a virtual speaker, and the audible sound 113 of the audio streams associated with that audio object can be rendered as if it is emanating from the location of the audio object. For illustrative purposes, an audible sound 113 emanating from the locations of the individual audio objects means an audible sound 113 emanating from a physical speaker associated with an audio object or an audible sound that is configured to simulate an audible sound 113 emanating from a virtual speaker at the location of that audio object.

According to one configuration, before or after spatializing the audio data 118 and before delivering there to the audio output devices 112, the audio data 118 that has been assigned a lower priority can be pre-processed, such as low-pass filtered, to further reduce their impact on the audio data 118 having a higher priority. The pre-processing can be performed by the audio pre-processor module 130 of the spatial audio generator 108 or any other component in the system 100.

It should be noted that the intelligent aggregator 104 may continuously monitor the various audio sources 102 and events involving the user 120 to determine if there are any changes in the received audio data 118 and in the context used to determine the priorities 106. For example, some audio sources 102 might be terminated by the user 120 and thus stop generating new audio data 118. Some new audio sources 102 might be launched by the user 120 that can provide new audio data 118 to the intelligent aggregator 104. In another example, the user 120 might have changed his location, thus triggering the change of the context. Any of the changes observed by the intelligent aggregator 104 can trigger the intelligent aggregator 104 to re-evaluate the various audio data 118 anal re-assign the priorities 106 to them.

In addition, the user 120 can instruct the system 100 to change the delivery of the audio data 118. In one implementation, the user 120 can interact with the system 100 through a user interaction module 116. The user 120 can send an instruction 124 to the user interaction module 116 indicating that he wants to change his focus to the audio data 118 of a different audio source 102. The instruction 124 can be sent through a user interface presented to the user 120 by the user interaction module 116, or through a voice command, or through gesture recognition. Upon receiving the instruction 120, the user interaction module 116 can forward it to the intelligent aggregator 104. The intelligent aggregator 104 can then adjust the priorities 106 of the audio data 118 according to the instruction and request the spatial audio generator 108 to shift the delivery of the audio data 118 in the multi-layer audio stack 122. Additional details regarding shifting the multi-layer audio stack 122 are provided below with regard to FIG. 4. Additional details regarding the configuration and operation of an illustrative computing device that can implement the system 100 will be provided below with regard to FIGS. 6 and 7.

Figure 2:
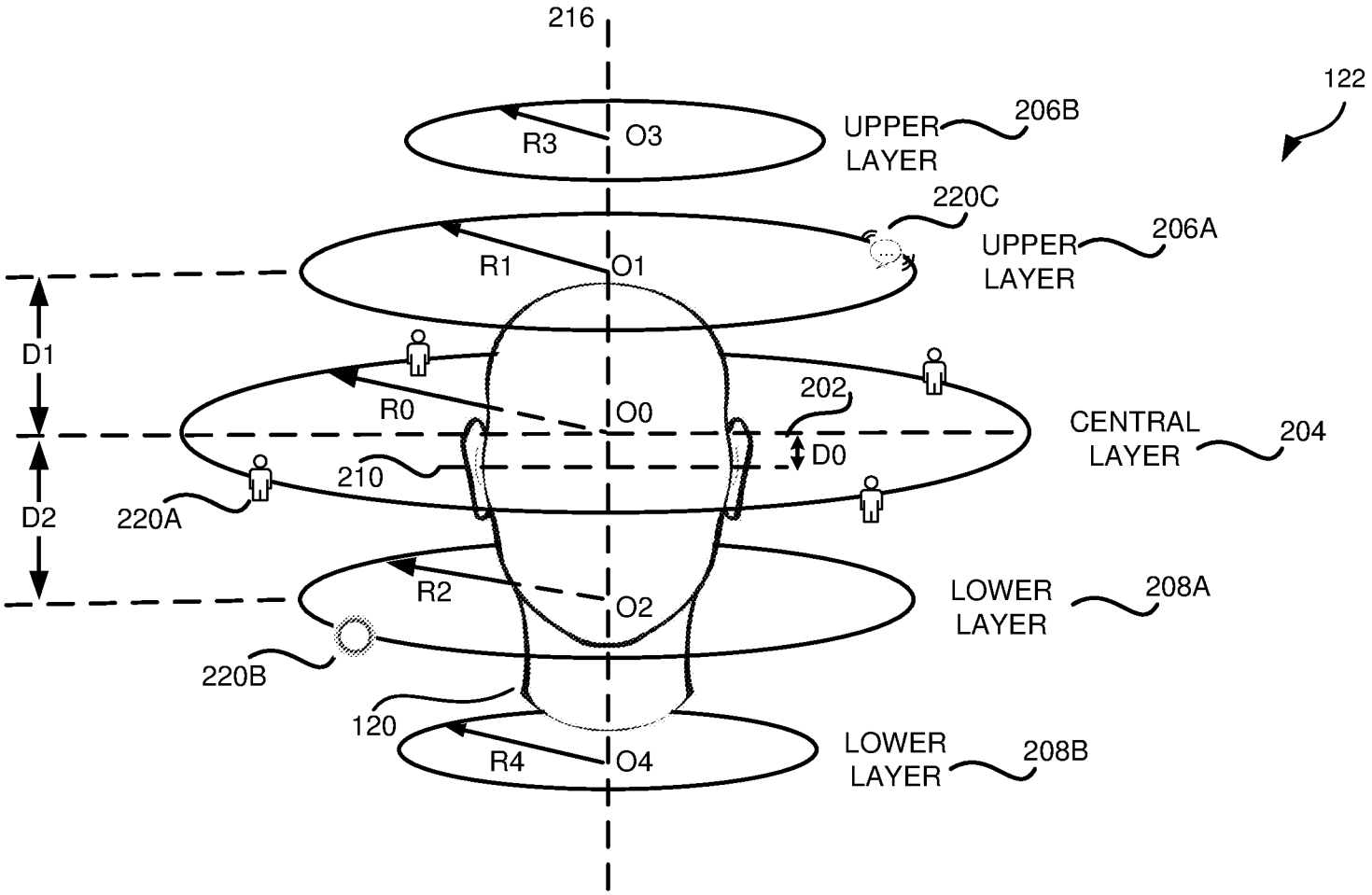
FIG. 2 illustrates a diagram showing an example multi-layer audio stack according to one configuration provided herein.

FIG. 2 is a diagram illustrating the multi-layer audio stack 122 according to one configuration provided herein. As shown in FIG. 2, the multi-layer audio stack 122 includes multiple spatial layers that are vertically distributed. In one configuration, the multi-layer audio stack 122 can include a central layer 204, one or more upper layers 206A-206B (which may be referred to herein individually as an upper layer 206 or collectively as the upper layers 206), and one or more lower layers 208A-208B (which may be referred to herein individually as a lower layer 208 or collectively as the lower layers 208). The central layer 204 can include a spatial region around the user 120's head at an elevation within a predetermined vertical distance from a reference line 210 of the user 120. The distance between the reference line 210 and the central layer 204 can be measured as the vertical distance (D0) between the center line 202 of the central layer 204 and the reference line 210. The reference line 210 can be the user's horizon line, or a line at the elevation of the user's ears, nose, eyes, or any other location associated with the user 120. The predetermined distance D0 can be set to be lower than a threshold T, which can be +/−3 inches. In one configuration, the distance D0 can be set to zero.

An upper layer 206 can include a spatial region at an elevation higher than the spatial region of the central layer 204 and thus is further away from the user's reference line 210 than the central layer 204. A lower layer can include a spatial region at an elevation lower than the spatial region of the central layer 204 and is also further away from the user's reference line 210 than the central layer 204.

According to one implementation, the size of the central layer 204 is larger than that of the lower layer 208 and the upper layer 206. Here, the size of a layer of the multi-layer audio stack 122, such as the central layer 204, upper layer 206 or the lower layer 208, can be measured in terms of the area or the circumference of the spatial region occupied by the layer. For example, the various layers of the multi-layer audio stack 122 can be implemented as a ring shape region with a center point O at the corresponding point on the vertical center line 216 of the user 120 and a radius R. As shown in FIG. 2, the central layer 204 has a center point O0 and a radius R0. The upper layers 206A and 206B have center points located at O1 and O3, respectively, and have radii R1 and R3, respectively. Similarly, the lower layers 208A and 208B have center points located at O2 and O4, respectively, and have radii R2 and R4, respectively. According to this implementation, the radii of the disclosed layers have the following relationship: R0>R1>R3 and R0>R2>R4. The radius R1 of the upper layer 206A and the radius R2 of the lower layer 208A can be the same size or different sizes. Similarly, the radius R3 of the upper layer 206B and the radius R4 of the upper layer 208B can be the same size or different sizes.

In addition to the size of the various layers, the distances between two adjacent layers, such as the distance D1 between the central layer 204 and the upper layer 206A and the distance D2 between the central layer 204 and lower layer 208A shown in FIG. 2, can also be adjusted. It should be noted that although FIG. 2 illustrates two upper layers 206 and two lower layers 208, any number of upper layers and lower layers can be utilized. Nonetheless, in implementations, in order to reduce the cognitive load of the user 120, the audio data 118 assigned to the upper layer 206 and the lower layer 208 that is not immediately adjacent to the central layer 204 are greatly diminished or even muted. As such, for illustration purposes, in the following descriptions, one upper layer 206 and one lower layer 208 will be employed in the multi-layer audio stack 122 along with the central layer 204.

According to one configuration, the audio data 118 having the highest priority $p_1$ (not shown on FIG. 2) can be delivered at the central layer 204, and the audio data 118 having the lower priority $p_2$ (also not shown on FIG. 2) can be delivered at the upper layer 206 or the lower layer 208. The central layer 204 can contain the user's focal point and make use of the full auditory field around the user's head. As such, the user 120 can hear the audio data 118 rendered in that layer clearly. For the upper layer 206 and lower layer 208, the user 120 can still "hear" the audio signals presented above and below his head position, but not as clearly as in the central layer 204.

The rationale is that humans naturally lose spatial awareness as sounds are positioned above and below their reference line 210, such as their horizon line, so there is a natural collapse of spatial information in these positions, which lessens cognitive load for the user 120. This lack of spatial information can be exploited in this implementation to help drive user's focus to the audio content rendered in the central layer 204, while still presenting audio data 118 from the audio sources 102 with lower priorities. By delivering audio data with different priorities at different vertical spatial locations, the system can significantly improve the human interaction with the device. Because the user can focus on the content of the most important audio signal without interference from other sources, the accuracy of the human interaction with the device can be increased. The number of inadvertent inputs by the user can also be reduced, thereby reducing the consumption of processing resources, and mitigating the use of network resources.

In addition to relying on the natural collapse of the spatial information in the upper layer 206 and lower layer 208, the system 100 can pre-process the audio data 118 to be rendered in the upper layer 206 and the lower layer 208 to further reduce the interference of the audio data 118 at these layers to enhance focus at the central layer 204. For example, as briefly discussed above with regard to FIG. 1, the spatial audio generator 108 can employ an audio pre-processor 130 to apply a low-pass filter on the audio data 118 to be rendered at the upper layer 206 and the lower layer 208 to muffle the sounds on those layers. Various other processing can be applied on the audio data 118 having low priorities before rendering.

According to one configuration, the user 120 is allowed to interact with the central layer 204, but not the upper layer 206 or the lower layer 208. The interaction can include providing inputs to the central layer 204, such as sending audio input to the audio source application 102. For example, if the central layer 204 is presenting the audio data 118 from an online meeting audio source 102, the user 120 can participate in the discussion and his voice signal will be provided as an input to the online meeting application 102 and be heard by other participants in the meeting. On the other hand, if the audio data 118 from the online meeting audio source 102 are presented at an upper layer 206 or a lower layer 208, the user 120 can only hear the discussion by other participants and any audio signal on his side will not be sent to the online meeting application 102 and thus cannot be heard by other participants.

As discussed above with regard to FIG. 1, one or more audio objects can be associated with the audio data 118 to be delivered at a layer of the multi-layer audio stack 122 and be associated with a location in the corresponding layer based on the shape of the layer. For example, FIG. 2 shows a ring shape layer, and the audio objects 220A-220C can be placed on the corresponding ring. For layers where there are multiple audio objects 220, these audio objects 220 can be placed to maintain a minimum distance between them so that audible sounds emanated from different audio objects are spatially distinguishable. On the central layer 204 shown in FIG. 2, a minimum angle can be maintained between any two adjacent audio objects 220A to achieve this goal. In addition, the audio object 220 can also move within a layer. The movement can be utilized to convey additional information to the user 120. For example, in an MR environment, an audio object 220, or a virtual speaker associated therewith, on the central layer 204 can emanate a sound indicating that a certain component of a device in the MR environment is broken and in the meanwhile, the audio object 220 can move to a position on the central layer 204 that is close to the location of the broken component to draw the attention of the user 120 to the direction of the broken component.

It should be appreciated that while FIG. 2 illustrates that the multi-layer audio stack 122 can include the upper layers 206 and the lower layers 208 along with the central layer 204, the multi-layer audio stack 122 can also have no upper layer 206 or lower layer 208, or both. For instance, if there is only one audio source 102, the multi-layer audio stack 122 can have just the central layer 204; if there are two audio sources 102, then the multi-layer audio stack 122 can have the central layer 204 and an upper layer 206 or a lower layer 208. As the number of audio sources increases, the central layer 204 can include both the upper layer 206 and the lower layer 208.

Figure 3A:
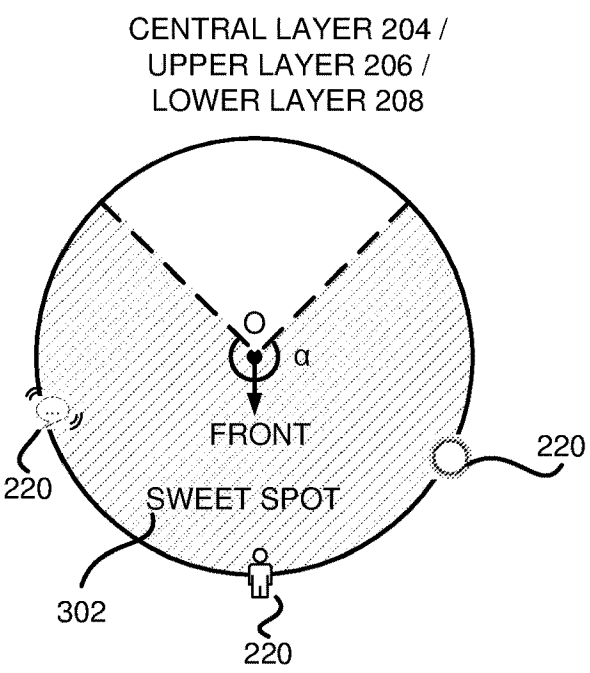
FIG. 3A illustrates a sweet spot for rendering audio data in a layer of the multi-layer audio stack.
Figure 3B:
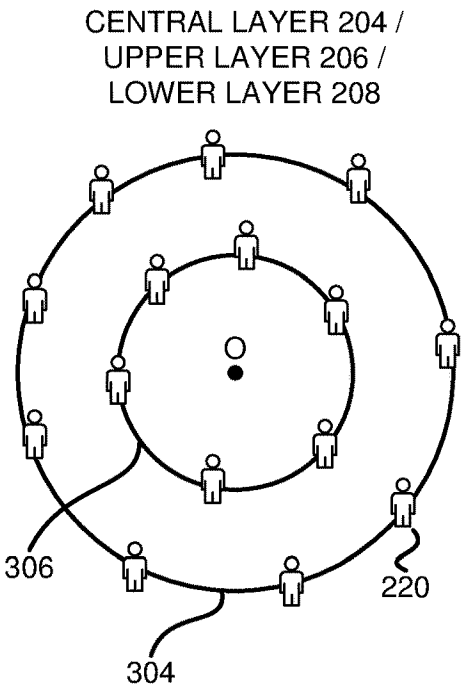
FIG. 3B illustrates an example implementation of the layers in the multi-layer audio stack.
Figure 3C:
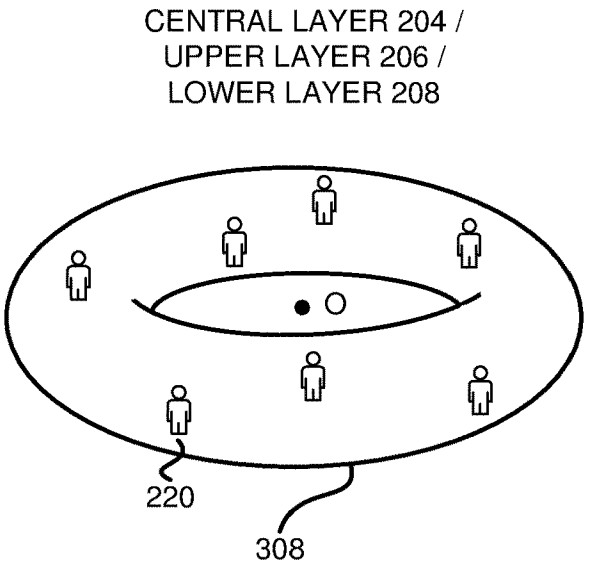
FIG. 3C illustrates another example implementation of the layers in the multi-layer audio stack.

FIGS. 3A-3C illustrate various implementations of the layers in the multi-layer audio stack 122. The implementations shown in FIGS. 3A-3C can be applied to any layer in the multi-layer audio stack 122, i.e. the central layer 204, any upper layer 206 and any lower layer 208. FIG. 3A illustrates a top view of a sweet spot 302 of a layer where the rendered audio data 118 can be better perceived by the user 120. Normally, the sweet spot 302 can include a "C"-shape area in front of the user 120 that spans a degree of a as shown in the shaded area 302 in FIG. 3A. Humans have better audio perception in the sweet spot 302 in front of them than in the area behind them (the unshaded area in FIG. 3A). As such, in one configuration, the audio objects 220 are placed in the sweet spot 302 of the corresponding layer when rendering the audio data 118.

FIG. 3B illustrates a top view of multi-ring implementation of the layers in the multi-layer audio stack 122. For each of the layers, there can be more than one ring, for example, the outer ring 304 and the inner ring 306 as shown in FIG.

3B. Audio objects 220 can be placed on the inner ring 306 and the outer ring 304. This type of layer implementation can be particularly useful when there are a large number of audio objects 220 to be placed in a layer. For example, in an online meeting application having a large number of participants, there can be tens of audio objects 220 to be rendered in one layer. As discussed above, in order for the user 120 to be able to spatially distinguish these participants, the corresponding audio objects 220 should be placed on the ring in a way that maintains a minimum distance between each audio object 220. This constraint restricts the number of audio objects 220 that can be placed in a layer in the single ring implementation shown in FIG. 2. By introducing additional rings, more audio objects 220 can be placed while satisfying the minimum distance requirement.

Another type of layer implementation is illustrated in FIG. 3C, where a layer employs a donut shape ring. This type of layer can explore the vertical space near the user 120's reference line 210 and provide six degrees of freedom for organizing the audio objects 220 within the spherical ring. This type of layer can also be employed in scenarios where a large number of audio objects 220 are to be rendered in one layer.

It should be understood that while not shown in FIG. 3, the multi-layer audio stack 122 can also adopt a disk shape for its layers or another other type of shape, either in one dimension, two dimensions or three dimensions. In addition, different layers may employ different types of shapes. For example, the central layer 204 can employ the 3-dimensional donut shape layer, while the upper layer 206 and the lower layer 208 can take the form of a disk shape or a multi-ring shape. Furthermore, the shape of a layer may change over time. In the above example of the online meeting application, as the number of participants of the meeting decreases, the central layer 204 can change its shape from a donut shape ring shown in FIG. 3C to a disk shape, and then to a single ring shape as shown in FIG. 2. Other mechanisms for dynamically changing the shape of the layers are also possible.

FIGS. 4A-4D illustrate e interaction of the user 120 with the multi-layer audio stack 122. FIG. 4A illustrates an example of rendering multiple audio sources 102 in the multi-layer audio stack 122. In this example, the intelligent aggregator 104 has assigned the highest priority $p_1$ to an online meeting audio source 102 where four participants are in the meeting. The audio data 118 associated with this audio source are thus rendered in the central layer 204 with fora audio objects 402 representing the four participants in the meeting. As discussed above with regard to FIG. 1, the four audio objects 402 can be generated by the spatial audio generator 108 using any available spatialization technology and be included in the spatialized audio data 110. The four audio objects 402 can be associated with the audio streams generated from the audio input by the four participants, respectively. The fora audio objects 402 can each be associated with a location in the central layer 204 as illustrated in FIG. 4A.

In addition, there are two other audio sources 102: a voice assistant application such as CORTANA provided by MICROSOFT CORPORATION of Redmond, Wash., and an annotation instance which can generate and play audio annotations. The intelligent aggregator 104 can determine that although the user 120 is currently focusing on the online meeting at the central layer 204, based on his context data 114 which shows that the user 120 launched the annotation instance to review the audio annotations during a previous meeting, the user is likely to visit the audio annotations next. As such, the intelligent aggregator 104 assigns the lower priority $p_2$ to the annotation instance and renders the audio data associated with it, i.e. the audio annotations, through an audio object 406 in the lower layer 208. The audio object 406 can be generated by the spatial audio generator 108 and included in the spatialized audio data 110. The audio object 406 can be associated with the audio stream for the audio annotations and be positioned at a location in the lower layer 208 as illustrated by FIG. 4A.

Similarly, the intelligent aggregator 104 might determine that the user 120 will also be likely to listen to the voice assistant next, and thus it can also assign the voice assistant application the lower priority $p_2$ and have it presented in the upper layer 206 through the audio object 404, which can be associated with the audio stream from the voice assistant and be positioned at a particular location in the upper layer 206.

As discussed above with regard to FIG. 1, the user 120 can navigate up or down the multi-layer audio stack 122 to bring the audio data 118 presented in a certain layer into the central layer 204 so that the user can then focus on such audio data 118. The user 120 can interact with the system 100 through the user interaction module 116 by sending an instruction 124 to shift the multi-layer audio stack 122 upward or downward. The intelligent aggregator 104 can then adjust the priorities 106 of the audio data 118 and their rendering according to the user's instruction 124.

FIG. 4B illustrates the rendering of the audio sources 102 presented in FIG. 4A after the user 120 gives the instruction to shift the multi-layer audio stack 122 upward to bring the sound annotations presented in the lower layer 208 to the central layer 204. The shifting causes the lower layer 208 to be shifted to the position of the center layer 204 and to be enlarged to the size of the center layer 204 to take full advantage of the higher focus auditory area of the user. The layer where the meeting audio data 118 was previously rendered would be shifted to the position of the upper layer and shrinks to the size of the upper layer 206 to reduce its audio impact on the user 120.

As a result of the shifting, the audio object 406 presenting the sound annotations is rendered in the central layer 204 and the meeting audio data 118 that were previously presented in the central layer 204 are now shifted up and presented in the upper layer 206 as background sounds. The audio data 118 that previously had a priority lower than $p_2$ and that were either muted or presented in a layer lower than the layer previously presenting the sound annotations can be moved up to the lower layer 208 and be played out as a background sound. In this way, the user 120 can listen to the sound annotations without disturbing the meeting or losing spatial understanding of participants in the meeting.

FIG. 4C illustrates the rendering of the multiple audio sources 102 shown in FIG. 4B after implementation of the user 120's instructions to shift the audio stack back. Here, the user 120 has finished listening to the audio annotations and decides to return to the meeting. He can instruct the system 100 to shift the multi-layer audio stack 122 downward. After the shifting, the multiple audio sources 102 are delivered in the same way as shown in FIG. 4A. While listening to the meeting presented in the central layer 204, the user might then decide to interact with the voice assistant in the upper layer 206. Based on the instruction of the user 120, the multi-layer audio stack 122 can shift downward and resize as shown in FIG. 4D, where the voice assistant is rendered in the central layer 204 and resized, and the user 120 can interact with it without disturbing the meeting that is rendered in the lower layer 208.

It should be noted that there are several scenarios where the user 120 might decide to shift the multi-layer audio stack 122. For example, a pre-selected ringtone might be played at the upper layer 206 or the lower layer 208 to draw attention of the user 120 to a particular event. For example, one of the meeting participants can send a signal to the user 120 indicating a request to have a private conversation. Such signal can be prioritized by the intelligent aggregator 104 so that it can be rendered in the upper layer 206 or the lower layer 208 using a special ringtone. In response to receiving such a signal, the user 120 can switch to the upper layer 206 or the lower layer 208 to talk to the requesting participant and then switch back to the central layer 204 after the conversation is over.

The multi-laser audio stack 122 can also support an interruption mode where the central layer 204 can be interrupted to present other audio data that require the immediate attention of the user 120. For example, when there is an emergency, the system can override the priorities of the audio data 118 and present the audio data indicating the emergency in the central layer 204. After the emergency is over, the multi-layer audio stack 122 can return to its normal state.

Figure 5:
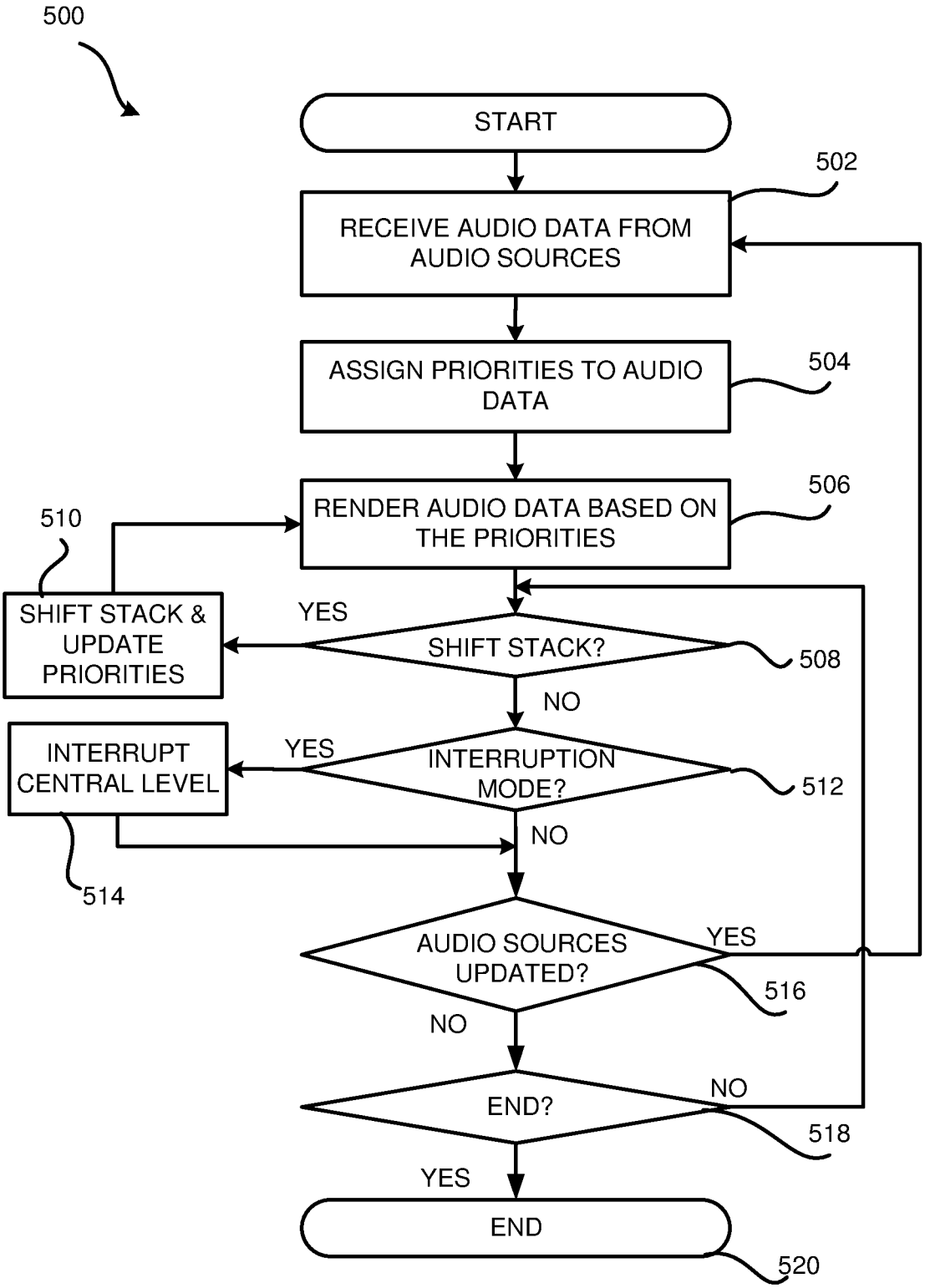
FIG. 5 illustrates a flow diagram of a routine for spatial delivery of multi-source audio data in a multi-layer audio stack.

Turning now to FIG. 5, aspects of a routine 500 for spatial delivery of multi-source audio data in a multi-layer audio stack are illustrated. It should be understood by those of ordinary skill in the art that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims.

It also should be understood that the illustrated methods can end at any time and need not be performed in their entireties. Some or all of the methods, and/or substantially equivalent operations, can be performed by execution of computer-readable instructions included on a computer-storage media, as defined below. The term "computer-readable instructions," and variants thereof, as used in the description and claims, is used expansively herein to include routines, applications, application modules, program modules, programs, components, data structures, algorithms, and the like. Computer-readable instructions can be implemented on various system configurations, including single-processor or multiprocessor systems, minicomputers, mainframe computers, personal computers, hand-held computing devices, microprocessor-based, programmable consumer electronics, combinations thereof, and the like.

Thus, it should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as states, operations, structural devices, acts, or modules. These operations, structural devices, acts, and modules may be implemented in software, in firmware, in special purpose digital logic, and any combination thereof.

Although the following illustration refers to the components of FIG. 1, it can be appreciated that the operations of the routine 500 may be also implemented in many other ways. For example, the routine 500 may be implemented, at least in part, by a processor of another remote computer or a local circuit. In addition, one or more of the operations of the routine 500 may alternatively or additionally be implemented, at least in part, by a chipset working alone or in conjunction with other software modules. Any service, circuit or application suitable for providing the techniques disclosed herein can be used in operations described herein.

With reference to FIG. 5, the routine 500 begins at operation 502, where the intelligent aggregator 104 receives, accesses or otherwise obtains audio data 118 from one or more audio sources 102. As described above, the audio source 102 might be a software application having live audio data 118 associated therewith, such as an online meeting application or a voice assistant application, or an application playing pre-generated audio data, such as a media player. The audio source might involve audio data 118 generated by a single speaker, such as audio data generated by the voice assistant, or by multiple speakers, such as the audio data generated by multiple participants in an online meeting instance.

After the audio data 118 are received or obtained, the routine 500 proceeds to operation 504 where the intelligent aggregator 104 can assign priorities 106 to each of the audio sources 102 and its associated audio data 118. The highest priority $p_1$ can be assigned to an audio source 102 and its associated audio data 118 that the user 120 would like to focus on at the moment. A lower priority $p_2$ can be assigned to an audio source 102 that the user would like to hear, but does not want to put full attention on, or to an audio source 102 that the user 120 most likely will want to focus on next as predicted by the intelligent aggregator 104. An even lower priority $p_3$ can be assigned to audio sources 102 that the user 120 is less interested in. Additional priority values p can be employed to prioritize the audio resources as needed. The assignment of the priorities 106 can be performed by the intelligent aggregator 104 based on the context data 114 and the context of the moment that the user 120 is in.

From operation 504, the routine 500 proceeds to operation 506 where the intelligent aggregator 104 can instruct the spatial audio generator 108 to render spatialized audio data 110 for the audio data 118 based on their assigned priorities 106. The spatial audio generator 108 can generate spatialized audio data 110 that includes one or more audio streams for the audio data 118, and associate each of the audio streams with an audio object 220 associated with a location. The locations of the audio objects 220 can be determined based on a multi-layer audio stack 122 that includes a central layer 204, an upper layer 206 and/or a lower layer 208. The audio data 118 having the highest priority $p_1$ can be rendered in the central layer 204 so as to make full use of the auditory field around the user's head. The rendering can be performed by associating the audio objects 220 corresponding to the audio data 118 with locations in the central layer 204 and generating audible sound for each of the audio objects 220 in the central layer as if the sound is emanating from the location of that particular audio object 220.

Audio data 118 having the lower priority $p_2$ can be rendered in the upper layer 206 or the lower layer 208 as a background sound that can be heard by the user but does not distract the user from the audio data 118 presented in the central layer 204. The rendering can be similar to that for the central layer 204, that is, by associating audio objects 220 with locations in the upper layer 206 or the lower layer 208 and generating audible sounds for each of the audio objects 220 as if the sound is emanating from the location of that particular audio object 220 in the upper layer 206 and the lower layer 208.

Next, at operation 508, a determination is made as to whether the user 120 has given the instruction to shift the multi-layer audio stack 122. If so, the routine proceeds to operation 510, where the intelligent aggregator 104 updates the priorities of the audio data 118 and instructs the spatial audio generator 108 to shift the multi-layer audio stack 122 according to the updated priorities 106. For example, if the user 120 gives an instruction to shift the multi-layer audio stack 122 upward, the intelligent aggregator 104 can assign the highest priority $p_1$ to the audio data 118 that was previously presented in the lower layer 208 so that it can now be presented in the central layer 204. The audio data 118 previously presented in the central layer 204 can be assigned a lower priority $p_2$ and it can now be presented in the upper layer 206 as a background sound. The routine 500 then returns to operation 506 and the process continues from there so that the audio data 118 can be rendered according to the updated priorities.

If, at operation 508, it is determined that the user 120 has not given an instruction to shift the multi-layer audio stack 122, the routine proceeds to operation 512 where a determination is made whether the system should enter the interruption mode. If so, the routine proceeds to operation 514, where the central layer 204 can be interrupted and audio data from another audio source can be presented in the central layer 204 regardless of its currently assigned priority. This interruption mode can be triggered when there is an event that requires the immediate attention of the user.

If, at operation 512, a determination is made that the interruption mode is not triggered, the routine 500 proceeds to operation 516, where the intelligent aggregator 104 determines whether there are any updates to be performed on the audio sources 102, such as when an audio source application has been terminated, audio data from an audio source has been consumed, or new audio sources have been identified. Upon identification of those updates on the audio sources 102, the routine 500 returns to operation 502 to update the audio data 118 obtained from the available audio sources and the process starts over for the new set of audio data 118. If it is determined at operation 516 that there are no updates to be performed on the audio sources, the routine 500 proceeds to operation 518 to determine if the audio rendering should be ended, such as when the user 120 gives the instruction to end the rendering process. If the audio rendering should not be ended, the routine 500 returns to operation 502 to continue running; if the audio rendering should be ended, then the routine proceeds to operation 520, where it ends.

It should be appreciated that the above-described subject matter may be implemented as a computer-controlled apparatus, a computer process, a computing system, or as an article of manufacture such as a computer-readable storage medium. The operations of the example methods are illustrated in individual blocks and summarized with reference to those blocks. The methods are illustrated as logical flows of blocks, each block of which can represent one or more operations that can be implemented in hardware, software, or a combination thereof. In the context of software, the operations represent computer-executable instructions stored on one or more computer-readable media that, when executed by one or more processors, enable the one or more processors to perform the recited operations.

Generally, computer-executable instructions include routines, programs, objects, modules, components, data structures, and the like that perform particular functions or implement particular abstract data types. The order in which the operations are described is not intended to be construed as a limitation, and any number of the described operations can be executed in any order, combined in any order, subdivided into multiple sub-operations, and/or executed in parallel to implement the described processes. The described processes can be performed by resources associated with one or more device(s) such as one or more internal or external CPUs or GPUs, and/or one or more pieces of hardware logic such as field-programmable gate arrays ("FPGAs"), digital signal processors ("DSPs"), or other types of accelerators.

All of the methods and processes described above may be embodied in, and fully automated via, software code modules executed by one or more general purpose computers or processors. The code modules may be stored in any type of computer-readable storage medium or other computer storage device, such as those described below. Some or all of the methods may alternatively be embodied in specialized computer hardware, such as that described below with regard to FIG. 6.

Any routine descriptions, elements or blocks in the flow diagrams described herein anchor depicted in the attached figures should be understood as potentially representing modules, segments, or portions of code that include one or more executable instructions for implementing specific logical functions or elements in the routine. Alternate implementations are included within the scope of the examples described herein in which elements or functions may be deleted, or executed out of order from that shown or discussed, including substantially synchronously or in reverse order, depending on the functionality involved as would be understood by those skilled in the art.

Figure 6:
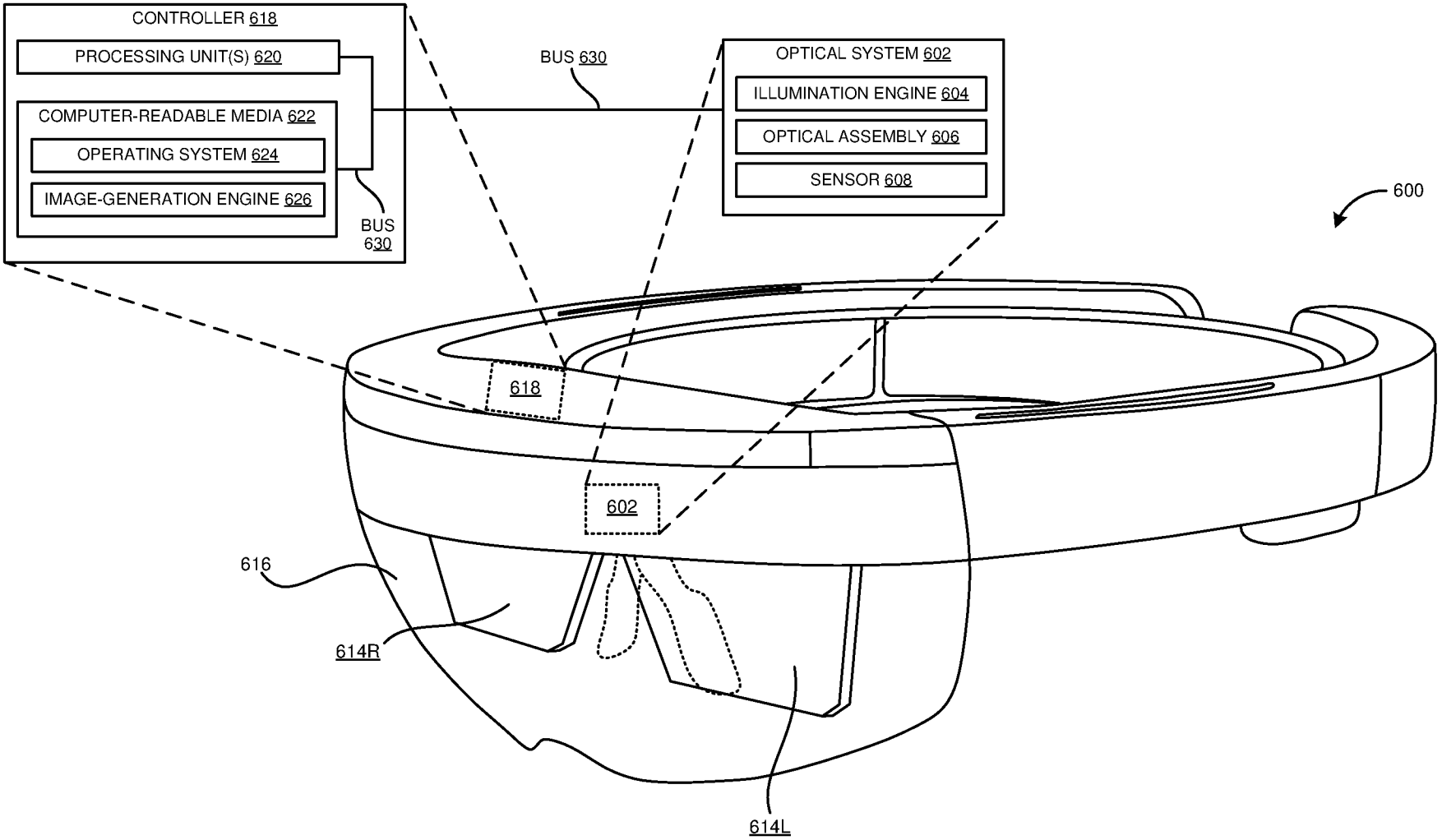
FIG. 6 is a computing device diagram showing aspects of the configuration and operation of an AR device that can implement aspects of the disclosed technologies, according to one embodiment disclosed herein.

FIG. 6 is a computing device diagram showing aspects of the configuration and operation of an AR device 600 that can implement aspects of the systems disclosed herein. As described briefly above, AR devices superimpose computer generated ("CG") images over a user's view of a real-world environment. For example, an AR device 600 such as that shown in FIG. 6 might generate composite views to enable a user to visually perceive a CG image superimposed over a real-world environment. As also described above, the technologies disclosed herein can be utilized with AR devices such as that shown in FIG. 6, as well as virtual reality ("VR") devices, MR devices, and other types of devices.

In the example shown in FIG. 6, an optical system 602 includes an illumination engine 604 to generate electromagnetic ("EM") radiation that includes both a first bandwidth for generating CG images and a second bandwidth for tracking physical objects (not shown in FIG. 6). The first bandwidth may include some or all of the visible-light portion of the EM spectrum whereas the second bandwidth may include any portion of the EM spectrum that is suitable to deploy a desired tracking protocol. In this example, the optical system 602 further includes an optical assembly 606 that is positioned to receive the EM radiation from the illumination engine 604 and to direct the EM radiation (or individual bandwidths thereof) along one or more predetermined optical paths.

For example, the illumination engine 604 may emit the EM radiation into the optical assembly 606 along a common optical path that is shared by both the first bandwidth and the second bandwidth. The optical assembly 606 may also include one or more optical components that are configured to separate the first bandwidth from the second bandwidth (e.g., by causing the first and second bandwidths to propagate along different image-generation and object-tracking optical paths, respectively).

In some instances, a user experience is dependent on the AR device 600 accurately identifying characteristics of a physical object or plane (such as the real-world floor) and then generating the CG image in accordance with these identified characteristics. For example, suppose that the AR device 600 is programmed to generate a user perception that a virtual gaming character is running towards and ultimately jumping over a real-world structure. To achieve this user perception, the AR device 600 might obtain detailed data defining features of the real-world environment around the AR device 600. In order to provide this functionality, the optical system 602 of the AR device 600 might include a laser line projector and a differential imaging camera in some embodiments.

In some examples, the AR device 600 utilizes an optical system 602 to generate a composite view (e.g., from a perspective of a user that is wearing the AR device 600) that includes both one or more CG images and a view of at least a portion of the real-world environment. For example, the optical system 602 might utilize various technologies such as, for example, AR technologies to generate composite views that include CG images superimposed over a real-world view. As such, the optical system 602 might be configured to generate CG images via an optical assembly 606 that includes a display panel 614.

In the illustrated example, the display panel includes separate right eye and left eye transparent display panels, labeled 614R and 614L, respectively. In some examples, the display panel 614 includes a single transparent display panel that is viewable with both eyes or a single transparent display panel that is viewable by a single eye only. Therefore, it can be appreciated that the techniques described herein might be deployed within a single-eye device (e.g. the GOOGLE GLASS AR device) and within a dual-eye device (e.g. the MICROSOFT HOLOLENS AR device).

Light received from the real-world environment passes through the see-through display panel 614 to the eye or eyes of the user. Graphical content computed by an image-generation engine 626 executing on the processing units 620 and displayed by right-eye and left-eye display panels, if configured as see-through display panels, might be used to visually augment or otherwise modify the real-world environment viewed by the user through the see-through display panels 614. In this configuration, the user is able to view virtual objects that do not exist within the real-world environment at the same time that the user views physical objects within the real-world environment. This creates an illusion or appearance that the virtual objects are physical objects or physically present light-based effects located within the real-world environment.

In some examples, the display panel 614 is a waveguide display that includes one or more diffractive optical elements ("DOEs") for in-coupling incident light into the waveguide, expanding the incident light in one or more directions for exit pupil expansion, and/or out-coupling the incident light out of the waveguide (e.g., toward a user's eye). In some examples, the AR device 600 further includes an additional see-through optical component, shown in FIG. 6 in the form of a transparent veil 616 positioned between the real-world environment and the display panel 614. It can be appreciated that the transparent veil 616 might be included in the AR device 600 for purely aesthetic and/or protective purposes.

The AR device 600 might further include various other components (not all of which are shown in FIG. 6), for example, front-facing cameras red/green/blue ("RGB"), black & white ("B&W"), or infrared ("IR") cameras), speakers, microphones, accelerometers, gyroscopes, magnetometers, temperature sensors, touch sensors, biometric sensors, other image sensors, energy-storage components (e.g. battery), a communication facility, a global positioning system ("GPS") a receiver, a laser line projector, a differential imaging camera, and, potentially, other types of sensors. Data obtained from one or more sensors 608, some of which are identified above, can be utilized to determine the orientation, location, and movement of the AR device 600. As discussed above, data obtained from a differential imaging camera and a laser line projector, or other types of sensors, can also be utilized to generate a 3D depth snap of the surrounding real-world environment.

In the illustrated example, the AR device 600 includes one or more logic devices and one or more computer memory devices storing instructions executable by the logic device(s) to implement the functionality disclosed herein. In particular, a controller 618 can include one or more processing units 620, one or more computer-readable media 622 for storing an operating system 624, other programs and data. The one or more processing units 620 and/or the one or more computer-readable media 622 can be connected to the optical system 602 through a system bus 630.

In some implementations, the AR device 600 is configured to analyze data obtained by the sensors 608 to perform feature-based tracking of an orientation of the AR device 600. For example, in a scenario in which the object data includes an indication of a stationary physical object within the real-world environment (e.g., a table), the AR device 600 might monitor a position of the stationary object within a terrain-mapping field-of-view ("FOV"). Then, based on changes in the position of the stationary object within the terrain-mapping FOV and a depth of the stationary object from the AR device 600, a terrain-mapping engine executing on the processing units 620 might calculate changes in the orientation of the AR device 600.

It can be appreciated that these feature-based tracking techniques might be used to monitor chances in the orientation of the AR device 600 for the purpose of monitoring an orientation of a user's head (e.g., under the presumption that the AR device 600 is being properly worn by a user). The computed orientation of the AR device 600 can be utilized in various ways.

The processing unit(s) 620, can represent, for example, a central processing unit ("CPU")-type processor, a graphics processing unit ("GPU")-type processing unit, an FPGA, one or more digital signal processors ("DSPs"), or other hardware logic components that might, in some instances, be driven by a CPU. For example, and without limitation, illustrative types of hardware logic components that can be used include ASICs, Application-Specific Standard Products ("ASSPs"), System-on-a-Chip Systems ("SOCs"), Complex Programmable Logic Devices ("CPLDs"), etc. The controller 618 can also include one or more computer-readable media 622, such as those described above with regard to FIG. 7.

Figure 7:
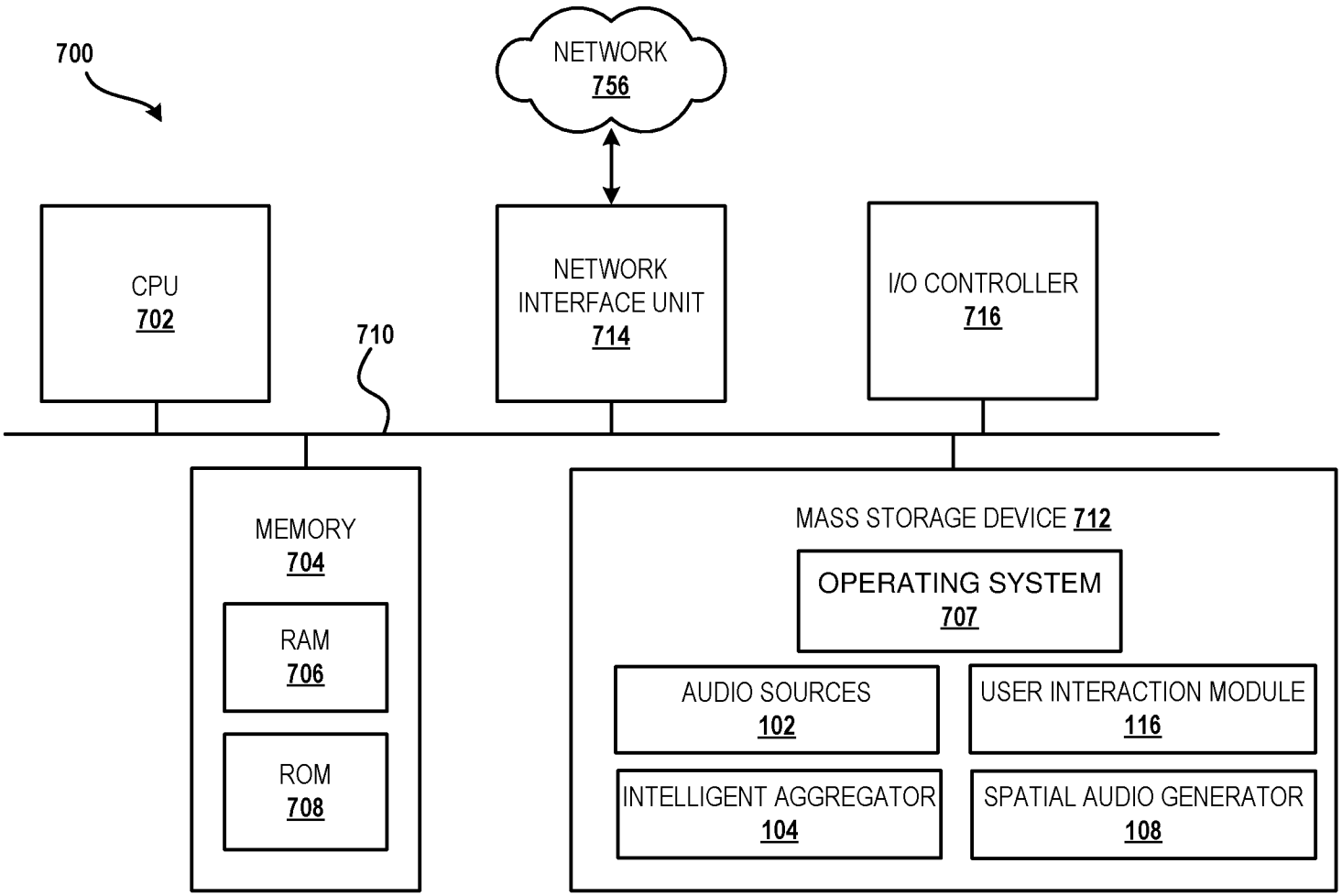
FIG. 7 is a computer architecture diagram illustrating an illustrative computer hardware and software architecture for a computing system capable of implementing aspects of the techniques and technologies presented herein.

FIG. 7 shows additional details of an example computer architecture 700 for a computer capable of executing the program components described herein. Thus, the computer architecture 700 illustrated in FIG. 7 illustrates an architecture for a server computer, mobile phone, a PDA, a smart phone, a desktop computer, a netbook computer, a tablet computer, and/or a laptop computer. The computer architecture 700 may be utilized to execute any aspects of the software components presented herein.

The computer architecture 700 illustrated in FIG. 7 includes a central processing unit 702 ("CPU"), a system memory 704, including a random access memory 706 ("RAM") and a read-only memory ("ROM") 708, and a system bus 710 that couples the memory 704 to the CPU 702. A basic input/output system containing the basic routines that help to transfer information between elements within the computer architecture 700, such as during startup, is stored in the ROM 708. The computer architecture 700 further includes a mass storage device 712 for storing an operating system 707, one or more audio sources 102 if the audio sources 102 are software applications, the intelligent aggregator 104, the user interaction module 116, the spatial audio generator 108, and other data and/or modules.

The mass storage device 712 is connected to the CPU 702 through a mass storage controller (not shown) connected to the bus 710. The mass storage device 712 and its associated computer-readable media provide non-volatile storage for the computer architecture 700. Although the description of computer-readable media contained herein refers to a mass storage device, such as a solid state drive, a hard disk or CD-ROM drive, it should be appreciated by those skilled in the art that computer-readable media can be any available computer storage media or communication media that can be accessed by the computer architecture 700.

Communication media includes computer readable instructions, data structures, program modules, or other data in a modulated data signal such as a carrier wave or other transport mechanism and includes any delivery media. The term "modulated data signal" means a signal that has one or more of its characteristics changed or set in a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

By way of example, and not limitation, computer storage media may include volatile and non-volatile, removable and non-removable media implemented in any method or technology for storage of information such as computer-readable instructions, data structures, program modules or other data. For example, computer media includes, but is not limited to, RAM, ROM, EPROM, EEPROM, flash memory or other solid state memory technology, CD-ROM, digital versatile disks ("DVD"), HD-DVD, BLU-RAY, or other optical storage, magnetic cassettes, magnetic tape, magnetic disk storage or other magnetic storage devices, or any other medium which can be used to store the desired information and which can be accessed by the computer architecture 700. For purposes the claims, the phrase "computer storage medium," "computer-readable storage medium" and variations thereof, does not include waves, signals, and/or other transitory and/or intangible communication media, per se.

According to various configurations, the computer architecture 700 may operate in a networked environment using logical connections to remote computers through the network 756 and/or another network (not shown in FIG. 7). The computer architecture 700 may connect to the network 756 through a network interface unit 714 connected to the bus 710. It should be appreciated that the network interface unit 714 also may be utilized to connect to other types of networks and remote computer systems. The computer architecture 700 also may include an input/output controller 716 for receiving and processing input from a number of other devices, including a keyboard, mouse, or electronic stylus (not shown in FIG. 7). Similarly, the input/output controller 716 may provide output to a display screen, a printer, or other type of output device (also not shown in FIG. 7).

It should be appreciated that the software components described herein may, when loaded into the CPU 702 and executed, transform the CPU 702 and the overall computer architecture 700 from a general-purpose computing system into a special-purpose computing system customized to facilitate the functionality presented herein. The CPU 702 may be constructed from any number of transistors or other discrete circuit elements, which may individually or collectively assume any number of states. More specifically, the CPU 702 may operate as a finite-state machine, in response to executable instructions contained within the software modules disclosed herein. These computer-executable instructions may transform the CPU 702 by specifying how the CPU 702 transitions between states, thereby transforming the transistors or other discrete hardware elements constituting the CPU 702.

Encoding the software modules presented herein also may transform the physical structure of the computer-readable media presented herein. The specific transformation of physical structure may depend on various factors, in different implementations of this description. Examples of such factors may include, but are not limited to, the technology used to implement the computer-readable media, whether the computer-readable media is characterized as primary or secondary storage, and the like. For example, if the computer-readable media is implemented as semiconductor-based memory, the software disclosed herein may be encoded on the computer-readable media by transforming the physical state of the semiconductor memory. For example, the software may transform the state of transistors, capacitors, or other discrete circuit elements constituting the semiconductor memory. The software also may transform the physical state of such components in order to store data thereupon.

As another example, the computer-readable media disclosed herein may be implemented using magnetic or optical technology. In such implementations, the software presented herein may transform the physical state of magnetic or optical media, when the software is encoded therein. These transformations may include altering the magnetic characteristics of particular locations within given magnetic media. These transformations also may include altering the physical features or characteristics of particular locations within given optical media, to change the optical characteristics of those locations. Other transformations of physical media are possible without departing from the scope and spirit of the present description, with the foregoing examples provided only to facilitate this discussion.

In light of the above, it should be appreciated that many types of physical transformations take place in the computer architecture 700 in order to store and execute the software components presented herein. It also should be appreciated that the computer architecture 700 may include other types of computing devices, including hand-held computers, embedded computer systems, personal digital assistants, and other types of computing devices known to those skilled in the art. It is also contemplated that the computer architecture 700 may not include all of the components shown in FIG. 7, may include other components that are not explicitly shown in FIG. 7, or may utilize an architecture completely different than that shown in FIG. 7.

It is to be appreciated that conditional language used herein such as, among others, "can," "could," "might" or "may," unless specifically stated otherwise, are understood within the context to present that certain examples include, while other examples do not include, certain features, elements and/or steps. Thus, such conditional language is not generally intended to imply that certain features, elements and/or steps are in any way required for one or more examples or that one or more examples necessarily include logic for deciding, with or without user input or prompting, whether certain features, elements and/or steps are included or are to be performed in any particular example. Conjunctive language such as the phrase "at least one of X, Y or Z," unless specifically stated otherwise, is to be understood to present that an item, term, etc. may be either X, Y, or Z, or a combination thereof.

It should also be appreciated that many variations and modifications may be made to the above-described examples, the elements of which are to be understood as being among other acceptable examples. All such modifications and variations are intended to be included herein within the scope of this disclosure and protected by the following claims.

Example Clauses

The disclosure presented herein encompasses the subject matter set forth in the following clauses.

Clause A: A computing device, comprising: a processor; and a memory having computer-executable instructions stored thereupon which, when executed by the processor, cause the computing device to receive audio data associated with a plurality of audio sources, assign a priority to audio data associated with each of the plurality of audio sources, deliver audio data to a user based on a multi-layer audio stack of the user by rendering audio data having a first priority to the user at a central layer of the multi-layer audio stack, the central layer comprising a center spatial region at a first elevation within a predetermined vertical distance from a reference line associated with the user, wherein rendering the audio data having the first priority comprises generating a first audible sound from the audio data having the first priority, the rendering providing a simulation that the first audible sound is emanating from the center spatial region, and rendering audio data having a second priority at an upper layer or a lower layer of the multi-layer audio stack, the upper layer comprising an upper spatial region at a second elevation higher than the center spatial region of the central layer and the lower layer comprising a lower spatial region at a third elevation lower than the center spatial region of the central layer, wherein rendering the audio data having the second priority comprises generating a second audible sound from the audio data having the second priority, the second audible sound configured to appear to emanate from the upper spatial region of the upper layer or the lower spatial region of the lower layer.

Clause B: The computing device of clause A, wherein a size of the center spatial region of the central layer is larger than a size of the upper spatial region of the upper layer and a size of the lower spatial region of the lower layer.

Clause C: The computing device of clauses A-B, wherein the memory having further computer-executable instructions stored thereupon which, when executed by the processor, cause the computing device to: receive an instruction to navigate to a selected layer in the multi-layer audio stack; in response to receiving the instruction, shift the multi-layer audio stack to place the selected layer at the central layer of the multi-layer audio stack, update the priority associated with the audio data of the plurality of audio sources to assign the first priority to audio data being delivered at the selected layer and a second priority to audio data being delivered at other layers of the multi-layer audio stack, and deliver the audio data associated with the plurality of audio sources based on the updated priority and the shifted multi-layer audio stack.

Clause D: The computing device of clauses A-C, wherein the memory having further computer-executable instructions stored thereupon which, when executed by the processor, cause the computing device to in response to an event occurring at the lower layer or the upper layer, generate a notification of the event at a corresponding layer, wherein the selected layer is the layer where the event occurred, and wherein the instruction to navigate to the selected layer is received in response to the notification of the event.

Clauses E: The computing device of clauses A-D, wherein delivering the audio data in the multi-layer audio stack comprises generating the first audible sound and the second audible sound using spatial audio technology to provide a simulation that the first audible sound and the second audible sound are emanating from respective audio objects located in a corresponding layer of the multi-layer audio stack.

Clause F: The computing device of clauses A-E, wherein delivering the audio data further comprises moving the respective audio objects from a first location to a second location within the respective layers.

Clause G: The computing device of clauses A-F, wherein the plurality of audio sources comprise at least one software application generating audio signals.

Clause H: A computer-readable storage medium having computer-executable instructions stored thereupon which, when executed by one or more processors of a computing device, cause the one or more processors of the computing device to: receive audio data associated with a plurality of audio sources; assign a priority to each of the plurality of audio sources and a corresponding audio data; deliver the audio data to a user based on the priority and a multi-layer audio stack comprising a central layer and at least one of a lower layer or a upper layer, the central layer comprising a center spatial region at a first elevation within a predetermined vertical distance from a reference line associated with the user, the upper layer comprising an upper spatial region at a second elevation higher than the center spatial region of the central layer and the lower layer comprising a lower spatial region at a third elevation lower than the center spatial region of the central layer, wherein delivering the audio data comprises: rendering audio data having a first priority at the central layer of the multi-layer audio stack by generating a first audible sound from the audio data having the first priority, the rendering providing a simulation that the first audible sound is emanating from the center spatial region, and rendering audio data having a second priority at the upper level or the lower layer of the multi-layer audio stack by generating a second audible sound from the audio data having the second priority, the rendering providing a simulation that the second audible sound is emanating from the upper spatial region or the lower spatial region.

Clause I: The computer-readable storage medium of clause H, wherein a size of the center spatial region of the central layer is larger than a size of the upper spatial region of the upper layer and a size of the lower spatial region of the lower layer.

Clause J: The computer-readable storage medium of clauses H-I, wherein delivering the audio data in the multi-layer audio stack comprises generating the first audible sound and the second audible sound using spatial audio technology to provide a simulation that the first audible sound and the second audible sound are emanating from respective audio objects located in a corresponding layer of the multi-layer audio stack.

Clause K: The computer-readable storage medium of clauses H-J, wherein a plurality of audio objects are associated with the audio data delivered in the central layer and are distributed with a predetermined minimum distance between any pair of the plurality of the audio objects.

Clause L: The computer-readable storage medium of clauses H-K, having further computer-executable instructions stored thereupon which, when executed by the processor, cause the computing device to: receive an instruction to navigate to a selected layer in the multi-layer audio stack; in response to receiving the instruction, shift the multi-layer audio stack to place the selected layer at the central layer of the multi-layer audio stack, update the priority associated with the audio data of the plurality of audio sources to assign the first priority to audio data being delivered at the selected layer and assign a priority lower than the first priority to audio data being delivered at other layers of the multi-layer audio stack, and deliver the audio data associated with the plurality of audio sources based on the updated priority and the shifted multi-layer audio stack.

Clause M: The computer-readable storage medium of clauses H-L, wherein a size of the center spatial region of the central layer is larger than a size of the upper spatial region of the upper layer and a size of the lower spatial region of the lower layer.

Clause N: A method, comprising: receiving audio data associated with a plurality of audio sources; assigning a priority to each of the plurality of audio sources and the corresponding audio data; delivering the audio data to a user based on the assigned priority and a multi-layer audio stack comprising a central layer and at least one of a lower layer or a upper layer, the central layer comprising a center spatial region at a first elevation within a predetermined vertical distance from a reference line associated with the user, the upper layer comprising an upper spatial region at a second elevation higher than the center spatial region of the central layer and the lower layer comprising a lower spatial region at a third elevation lower than the center spatial region of the central layer, wherein delivering the audio data comprises: rendering audio data having a first priority to the user at the central layer of the multi-layer audio stack by generating a first audible sound from the audio data having the first priority, the rendering providing a simulation that the first audible sound is emanating from the center spatial region, and rendering audio data having a second priority at the upper level or the lower layer of the multi-layer audio stack by generating a second audible sound from the audio data having the second priority, the rendering providing a simulation that the second audible sound is emanating from the upper spatial region or the lower spatial region.

Clause O: The method of clause N, wherein delivering the audio data at the upper layer or the lower layer of the multi-layer audio stack further comprises pre-processing the audio data before rendering the audio data at the corresponding layer.

Clause P: The method of clauses N-O, wherein preprocessing the audio data comprises applying a low pass filter on the audio data.

Clause Q: The method of clauses N-P, wherein the center spatial region of the central layer, the upper spatial regions of the upper layer and the lower spatial regions of the lower layer form a first ring shape area, a second ring shape area and a third ring shape area, respectively.

Clause R: The method of clauses N-Q, wherein a first radius of the first ring shape area of the central layer is larger than a second radius of the second ring shape area of the upper layer and a third radius of the third ring shape area of the lower layer.

Clause S: The method of clauses N-R, wherein the ring shape area of the central layer spans vertically in space into a donut shape area.

Clause T: The method of clauses N-S, further comprising: receiving an instruction to navigate to a selected layer in the multi-layer audio stack; in response to receiving the instruction, shifting the multi-layer audio stack to place the selected layer at the central layer of the multi-layer audio stack and adjusting the size of the layers of the multi-layer audio stack, updating the priority associated with the audio data of the plurality of audio sources to assign the first priority to audio data being delivered at the selected layer and a priority lower than the first priority to audio data being delivered at other layers of the multi-layer audio stack, and delivering the audio data associated with the plurality of audio sources based on the updated priority and the updated multi-layer audio stack.

Among many other technical benefits, the technologies disclosed herein enable more efficient use of the auditory field around a user's head to decrease the user's cognitive load and increase his focus. Other technical benefits not specifically mentioned herein can also be realized through implementations of the disclosed subject matter.

Although the techniques have been described in language specific to structural features and/or methodological acts, it is to be understood that the appended claims are not necessarily limited to the features or acts described. Rather, the features and acts are described as example implementations of such techniques.

What is claimed is:

1. A computing device, comprising:

a processor; and a memory having computer-executable instructions stored thereupon which, when executed by the processor, cause the computing device to:

receive audio data from a plurality of audio sources;

render audio data from a first audio source of the plurality of audio sources for a first elevation of a plurality of elevations of a multi-layer audio stack wherein rendering the audio data from the first audio source provides an effect causing a first audible sound to appear to emanate from the first elevation, the first elevation based on data indicative of a priority that is determined from a context of a target listener of the first audible sound determined based on the target listener's usage behavior over time; and render audio data from a second audio source of the plurality of audio sources for a second elevation of the plurality of elevations of the multi-layer audio stack wherein rendering the audio data from the second audio source provides an effect causing a second audible sound to appear to emanate from the second elevation of the plurality of elevations of the multi-layer audio stack, the second elevation determined based on data indicative of a priority that is determined from a context of a target listener of the second audible sound determined based on the target listener's usage behavior over time.

2. The computing device of claim 1, wherein the computer-executable instructions further cause the computing device to:

receive an input to navigate to the second elevation in the multi-layer audio stack;

in response to receiving the input, render the audio data from the second audio source with an effect that causes the second audible sound to appear to emanate from the first elevation of the plurality of elevations of the multi-layer audio stack.

3. The computing device of claim 2, wherein the rendering of the audio data from the first audio source is rendered with an effect that causes the first audible sound to appear to emanate from an elevation at a predetermined distance from the first elevation.

4. The computing device of claim 1, wherein the rendering of the audio data from the first audio source is rendered with an effect that causes the first audible sound to appear to emanate from a location having a first horizontal distance from a user.

5. The computing device of claim 4, wherein the rendering of the audio data from the second audio source is rendered with an effect that causes the second audible sound to appear to emanate from a location having a second horizontal distance from a user, wherein the second horizontal distance is less than the first horizontal distance.

6. The computing device of claim 1, wherein individual audio sources of the plurality of audio sources each comprise at least one software application generating the audio data.

7. A computer-readable storage medium having computer-executable instructions stored thereupon which, when executed by one or more processors of a computing device, cause the one or more processors of the computing device to:

receive audio data associated with a plurality of audio sources;

render audio data from a first audio source of the plurality of audio sources for a first elevation of a plurality of elevations of a multi-layer audio stack, wherein rendering the audio data from the first audio source provides an effect causing a first audible sound to appear to emanate from a first spatial region for the first elevation, the first elevation based on data indicative of a priority that is determined from a context of a target listener of the first audible sound determined based on the target listener's usage behavior over time; and render audio data from a second audio source of the plurality of audio sources for a second elevation of the plurality of elevations of the multi-layer audio stack, wherein rendering the audio data from the second audio source provides an effect causing a second audible sound to appear to emanate from a second spatial region for the second elevation of the plurality of elevations of the multi-layer audio stack, the second elevation determined based on data indicative of the priority that is determined from a context of a target listener of the second audible sound determined based on the target listener's usage behavior over time.

8. The computer-readable storage medium of claim 7, wherein a size of the first spatial region is larger than a size of the second spatial region.

9. The computer-readable storage medium of claim 7, wherein rendering the audio data in the multi-layer audio stack comprises generating the first audible sound and the second audible sound using spatial audio technology to provide a simulation that the first audible sound and the second audible sound are emanating from respective audio objects located in a corresponding spatial region.

10. The computer-readable storage medium of claim 9, wherein a plurality of audio objects is associated with the audio data rendered in the first spatial region and is distributed with a predetermined minimum distance between any pair of the plurality of the audio objects.

11. The computer-readable storage medium of claim 7, wherein the computer-executable instructions further cause the computing device to:

receive a user input to navigate to the second elevation in the multi-layer audio stack; and in response to receiving the user input, render the audio data from the second audio source with an effect that causes the second audible sound to appear to emanate from the first spatial region for the first elevation.

12. The computer-readable storage medium of claim 7, wherein a radius of the first spatial region is larger than a radius of the second spatial region, wherein the radius of the second spatial region decreases as the second elevation increases with respect to the first elevation.

13. A method, comprising:

receiving audio data from a plurality of audio sources;

rendering audio data from a first audio source of the plurality of audio sources for a first elevation of a plurality of elevations of a multi-layer audio stack, wherein rendering the audio data from the first audio source provides a first effect causing a first audible sound to appear to emanate from the first elevation, the first elevation based on data indicative of a priority that is determined from a context of a target listener of the first audible sound determined based on the target listener's usage behavior over time; and rendering audio data from a second audio source of the plurality of audio sources for a second elevation of the plurality of elevations of the multi-layer audio stack, wherein rendering the audio data from the second audio source provides a second effect causing a second audible sound to appear to emanate from the second elevation of the plurality of elevations of the multi-layer audio stack, the second elevation determined based on data indicative of a priority that is determined from a context of a target listener of the second audible sound determined based on the target listener's usage behavior over time.

14. The method of claim 13, wherein rendering the audio data for the first elevation or the second elevation further comprises pre-processing the audio data before rendering the audio data at a corresponding layer.

15. The method of claim 14, wherein preprocessing the audio data comprises applying a low pass filter on the audio data.

16. The method of claim 13, wherein the first effect causes the first audible sound to appear to emanate from a first region for the first elevation, and the effect causes the second audible sound to appear to emanate from a second region for the second elevation, wherein the first elevation is closer to a reference line associated with a user than the second elevation.

17. The method of claim 16, wherein a first radius of the first region is larger than a second radius of the second region.

18. The method of claim 16, wherein the first region spans vertically in space into a donut shape region.

19. The method of claim 13, further comprising:

receiving an instruction to navigate to a selected layer in the multi-layer audio stack;

in response to receiving the instruction, rendering the audio data from the second audio source with another effect that causes the second audible sound to replace the first audible sound, wherein the second audible sound appears to emanate from the first elevation of the plurality of elevations of the multi-layer audio stack.

* * * * *